United States Patent [19]

Mailer et al.

[11] Patent Number: 4,479,598

[45] Date of Patent: Oct. 30, 1984

[54] FRICTION FEED TRACTOR

[75] Inventors: Werner H. Mailer; Henry C. Sipe, both of Waynesboro, Va.

[73] Assignee: Genicom Corporation, Waynesboro, Va.

[21] Appl. No.: 405,409

[22] Filed: Aug. 5, 1982

[51] Int. Cl.[3] ..... B65H 17/38; B65H 17/20; B41J 11/30; B41J 11/34

[52] U.S. Cl. ..... 226/74; 226/108; 226/186; 400/616.1; 400/636

[58] Field of Search ..... 226/181, 186, 187, 170, 226/152, 83, 84, 85, 108, 74, 75; 400/616.1, 616.2, 616.3, 636

[56] References Cited

U.S. PATENT DOCUMENTS

| | | | |
|---|---|---|---|
| 2,664,988 | 1/1954 | Metzner | 400/618 |
| 3,072,225 | 1/1963 | Manning et al. | 428/593 |
| 3,082,970 | 3/1963 | Rasmussen | 226/186 X |
| 3,101,913 | 8/1963 | Davis | 226/187 X |
| 3,285,164 | 11/1966 | Matavazos | 101/91 |
| 3,308,919 | 3/1967 | Cunningham | 400/690 |
| 3,323,700 | 6/1967 | Epstein et al. | 226/17 |
| 3,421,612 | 1/1969 | Pitt | 400/584 |
| 3,707,215 | 12/1972 | Familant | 400/618 |
| 3,917,048 | 11/1975 | Riley | 226/187 X |
| 4,000,762 | 1/1977 | Mizuno | 226/187 X |
| 4,010,883 | 3/1977 | Ritter | 226/171 |

*Primary Examiner*—Stuart S. Levy
*Assistant Examiner*—Scott J. Haugland
*Attorney, Agent, or Firm*—Cushman, Darby & Cushman

[57] ABSTRACT

The tractor comprises a frame, a drive roller carried by the frame, a pressure roller and a carrier therefor. The pressure roller is biased against the drive roller. The pressure roller can be moved to be spaced slightly from the drive roller to enable paper adjustment or it can be moved to a storage position. The friction feed tractor has a paper edge guide which is automatically moved to a storage position when not in use. In their storage positions the friction feed tractor and paper edge guide act as paper supports for pin feed tractor operation.

14 Claims, 6 Drawing Figures

FRICTION FEED TRACTOR

BACKGROUND OF THE INVENTION

A high speed printer can be used to print on cut forms which may or may not be mounted on a backing. The forms are fed through the printer by means of a friction feed tractor. The paper is pinched between two rollers, at least one of which is driven. The paper may instead have apertured sides in which case a pin feeder is employed to move the paper. In the past, one or the other is used in the printer.

SUMMARY OF THE INVENTION

It is an important object of the present invention to provide a friction feed tractor for a printer which also has a pin feeder.

Another object is to provide in such a printer means by which the friction feed tractor can be placed in a position so as not to interfere with the pin feeder.

In summary, there is provided a friction feed tractor for moving paper along a predetermined paper path and comprising a frame, a drive roller carried by the frame, a pressure roller mechanism carried by the frame and including a pressure roller and a carrier for the pressure roller, the pressure roller mechanism having use and storage positions respectively in and out of the paper path, a paper edge guide having guide use and guide storage positions respectively in and out of the paper path, means biasing the pressure roller mechanism to the use position and holding the pressure roller against the drive roller, means for moving the pressure roller mechanism against the force of the biasing means into the storage position, and said paper edge guide including means engageable by the pressure roller mechanism in response to movement of said pressure roller to said roller storage position to move said paper edge guide to the guide storage position.

The friction feed tractor may also comprise a further means for slightly moving the pressure roller mechanism against the force of the biasing means so that the pressure roller is spaced slightly from the drive roller.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings, a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
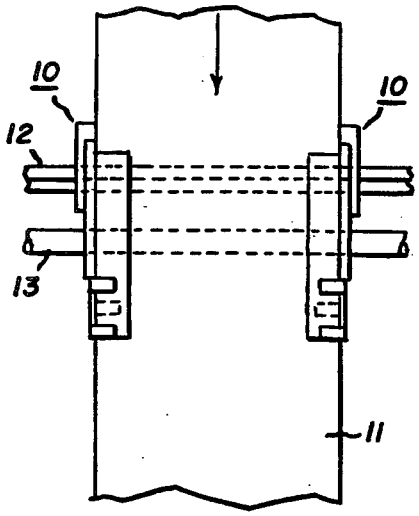
FIG. 1 is a schematic view of combined pin feed and friction feed drives for a printer adapted for friction feed paper handling.

Turning now to FIG. 1 of the drawings, there is depicted a friction feed tractor 10 for feeding paper 11 through a printer. The tractor 10 is disposed adjacent to one side of the paper 11 and an identical tractor is disposed adjacent to the other side. Each tractor is relatively narrow, on the order of about one inch in width. It grips the associated side of the paper between two rubber rollers, one of which is driven, thereby to move the paper 11 in the direction of the arrow. The tractor 10 may be on the input or the output of the printing mechanism itself. The two friction feed tractors are carried by a shaft 12 and a shaft 13, the friction feed tractor 10 being carried adjacent to one end of each of the shafts and the other friction feed tractor being carried at the other ends of the shafts. The shaft 12 is square in lateral cross section and is operatively connected to a driving apparatus so as to rotate. The two friction feed tractors may be moved laterally on the shafts 12 and 13 in accordance with various paper widths or desired print locations. In FIG. 1 two pin feed tractors, not shown, and corresponding to the two friction feed tractors, have been swung out of position to enable activation of the friction feed tractors.

Figure 2:
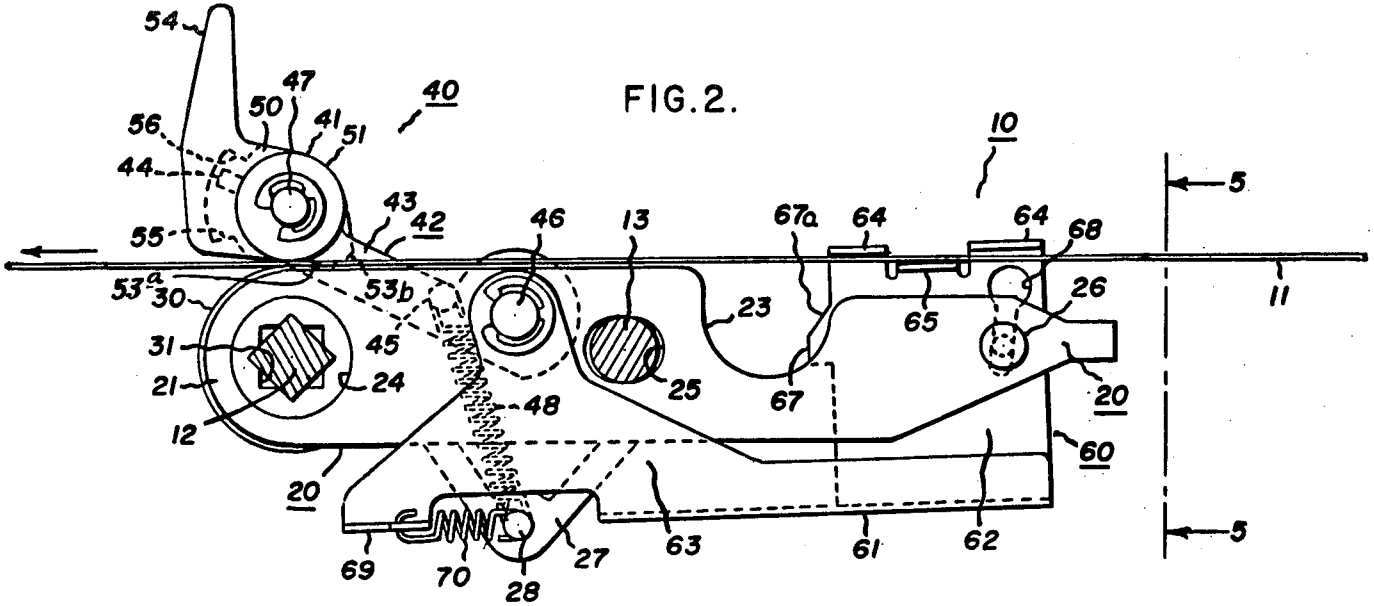
FIG. 2 is a side elevational view of a friction feed tractor incorporating the features of the present invention with the pressure roller engaging the drive roller.

Referring to FIG. 2, the tractor 10 comprises a frame 20 having a pair of spaced side walls 21 at one end, the side walls 21 protruding rearwardly toward the exit end of paper moving through the tractor. In this application, the term "rearwardly" refers to the exit or left-hand end of the tractor as viewed in FIG. 2, and the term "forwardly" refers to the entry or right-hand end. The frame 20 has a U-shaped notch 23 in the middle region to accommodate pressure rollers 41 to be described. The side walls 21 are provided to define a U-shaped recess to accommodate a drive roller 30. A round opening 24 is provided in the side wall 21 adjacent to its exit end and an opening 25 is provided centrally in the frame 20. Adjacent to the forward end of the frame 20 and carried by the frame 20 is an outwardly protruding, headed pin 26. Depending from the frame 20 is a mounting flange 27 carrying an outwardly directed, headed pin 28.

The friction feed tractor 10 comprises a drive roller 30 mounted between the side walls 21 and having a sixteen sided hole 31 which snugly receives the square shaft 12 as shown. Thus, rotation of the shaft 12 will cause the drive roller 30 to rotate in the same direction.

The friction feed tractor 10 further comprises a pressure roller mechanism 40 having a pressure roller 41 and a carrier 42 therefor. The carrier 42 includes a platelike arm 43 having enlarged ends, one of such ends carrying a tab 44. An outwardly directed pin 45 is attached to the arm 43. The arm 43 is rotatably mounted to the frame 20 and is rotatable about an axis defined by the point 46. The pressure roller is rotatably mounted on the arm 43 adjacent to the other end thereof so as to be rotatable about an axis defined by the point 47. A spring 48 is connected between the pin 45 and the pin 28, thereby biasing the pressure roller 41 counterclockwise to be held in contact with the drive roller 30, in an over-center-type construction. Rotation of the drive roller 30 in a counterclockwise direction will move the paper 11 in the direction of the arrow.

The friction feed tractor 10 further comprises a spacer mechanism 50 having a plate 51 disposed between the platelike arm 43 and the roller 41, the plate 51 also being rotatable about the axis defined by the point 47. Coplanar with the plate 51 is a generally trapezoidal projection, one side of which defines a camming surface 53*a* and the end of which defines a shoulder 53*b*. As shown in FIG. 2, the spring 48 holds the camming surface 53*a* against the side walls 21. The spacer mechanism 50 includes a finger grip 54 which is cut out to define shoulders 55 and 56.

Figure 4:
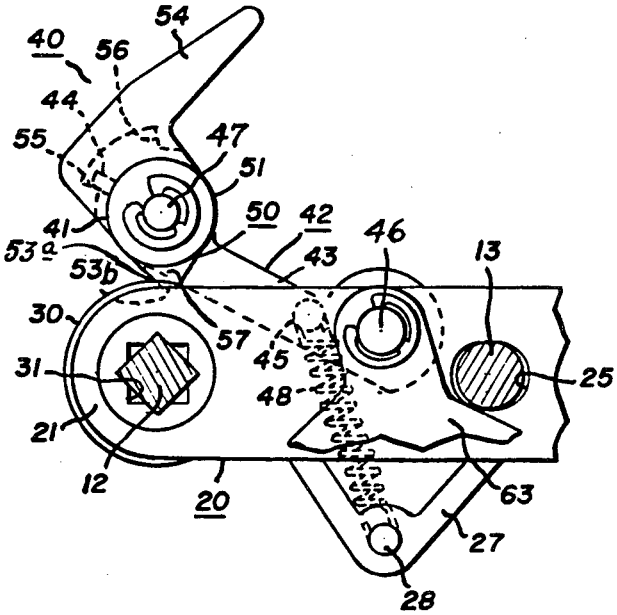
FIG. 4 is a fragmentary view of the friction feed tractor with the pressure roller spaced slightly from the drive roller.

The spacer mechanism 50 provides a means to space the pressure roller 41 from the drive roller 30 to enable insertion of the paper between the two or to adjust the paper. In use, the operator grasps the finger grip 54 and rotates the same clockwise, causing the plate 51 to rotate about the axis defined by the point 47. The shoulder 55 engages the tab 44. The camming surface 53*a* is initially against one of the side walls 21 and upon movement of the grip 54 causes the entire pressure roller mechanism 40 to move clockwise, against the force of the spring 48. The shoulder 53*b* will seat against the side wall 21 as depicted in FIG. 4, thereby to create a space 57 between the rollers 30 and 41, to enable paper to be fed between the rollers or to be adjusted. To return the pressure roller 41 to its use position in engagement with the drive roller 30, the finger grip 54 is rotated counterclockwise until the shoulder 56 engages the tab 44. Continued rotation causes the camming surfaces 53*a* again to rest on the side wall 21.

Figure 5:
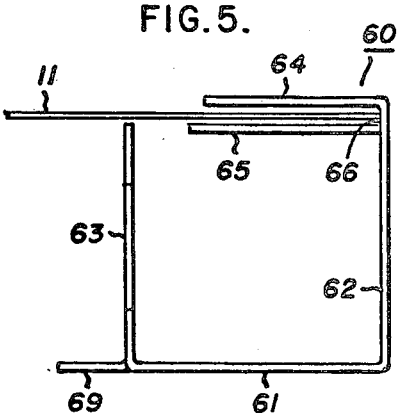
FIG. 5 is a view taken along the line 4—4 of FIG. 1 of just the edge guide.
Figure 3:
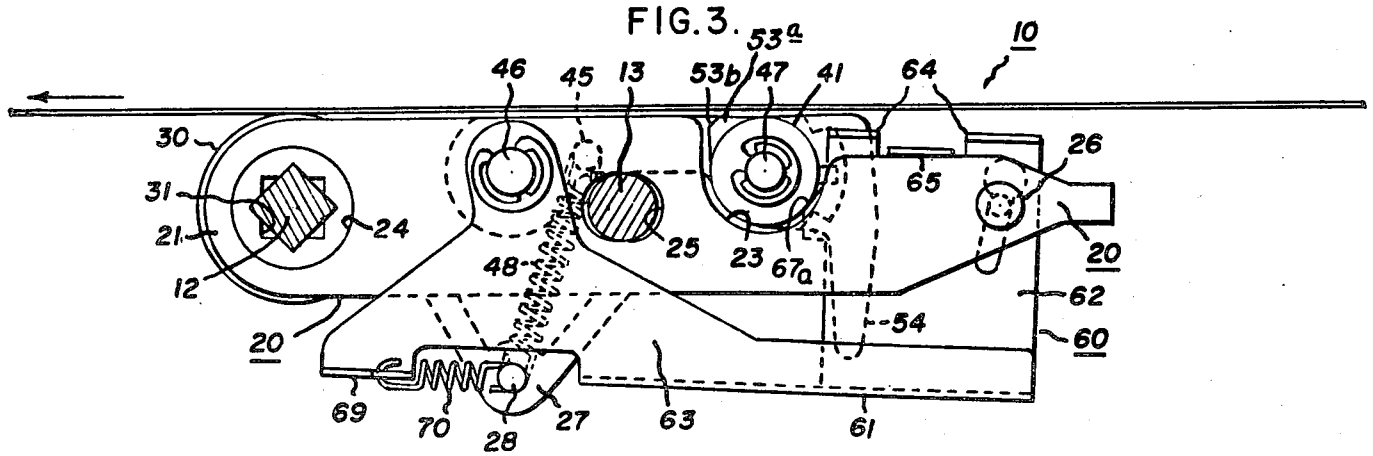
FIG. 3 is a view like FIG. 2 but with the pressure roller mechanism and the edge guide in their storage positions.

The friction feed tractor 10 further comprises an edge guide 60 shown in FIGS. 2, 3 and 5 which is generally U-shaped, having a bottom wall 61 as shown in FIG. 5 and side walls 62 and 63. The upper edges of the side wall 62 are bent inwardly to define two coplanar upper arms 64 and a lower arm 65 disposed closer to the bottom wall 61. The space thus defined between the arms 64 and 65 receives the paper 11 therebetween. The inner surface of the side wall 62 in the region between the arms 64 and 65 defines an abutment surface 66 against which an edge of the paper 11 rides. A projection 67 (shown in FIGS. 2 and 3) on the rear end of the side wall 62 is adjacent the forward portion of the recess 23. The projection 67 has a camming surface 67*a* inclined downwardly and rearwardly for reasons to be explained. In the side wall 62 near the forward end thereof is a keyhole 68, the large portion of which receives the headed pin 26. The edge guide 60 has a tab 69 generally coplanar with the bottom wall 61 but inwardly directed as can be seen in FIG. 5.

The side wall 63 of the edge guide 60 is rotatably mounted to the frame 22 about the axis of rotation defined by the point 46. Thus, the edge guide 60 and the pressure roller mechanism 40 are rotatably mounted to the frame 22 about the same point 46. A spring 70 is connected to the pin 28 on the frame 22 and to the tab 69, thereby tending to rotate the edge guide 60 counterclockwise, as viewed in FIG. 2. The extent of such rotation is limited by the pin 26 engaging the lower end of the keyhole 68.

The edge guide 60 is in its use position in FIG. 2 because it is disposed in the path of the paper 11. Likewise the pressure roller mechanism 40 is in its use position in FIG. 2 so that the paper 11 is guided by the edge guide 60 and is pulled through by the action of the pressure roller mechanism 40 in association with the drive roller 30. The friction feed tractor on the other side of the paper 11 performs in exactly the same way.

Figure 6:
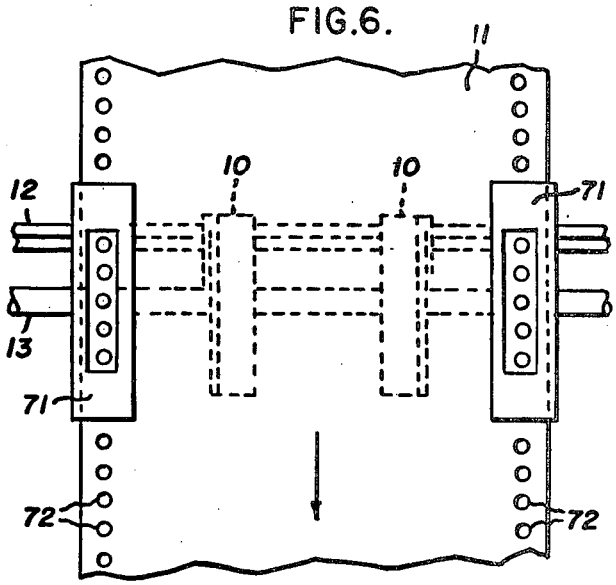
FIG. 6 is a schematic view of combined pin feed and friction feed drive for a printer adapted for pin feed paper handling.

When the printer with which the friction feed tractor 10 is used is to transport apertured paper by means of a pin feed mechanism it is necessary that the friction feed tractor 10 be moved to an out-of-the-way condition as shown in FIG. 6 and the pin feed tractors 71 moved into position to engage the sprocket holes 72 in the wider pin feed paper 11. This is effected by moving the pressure roller mechanism 40 shown in FIG. 3 to its storage position by gripping the finger grip 54 and rotating the carrier 42 against the force of the spring 48 until the arm 43 passes the 90° position, whereupon the over-center construction causes the spring 48 to rotate the pressure roller mechanism 40 clockwise and pull the pressure roller 41 downwardly into the recess or notch 23. In the storage position of the pressure roller mechanism depicted in FIG. 3, the roller 41 is disposed beneath the path of the paper 11 so that the pin feed mechanism can operate thereon as shown in FIG. 6. In this position, both friction feed tractors are used as paper supports in between the pin feed tractors.

Also, for this operation the edge guide 60 must be moved from its use position to its storage position out of the paper path. This is accomplished automatically by virtue of the roller 41 engaging the camming surface 67*a* as it is entering the recess 23. The roller 41 thus causes the edge guide 60 to rotate clockwise about the point 46 against the force of the spring 70. The maximum clockwise rotation is attained when the roller 41 seats in the recess or notch 23. As can be seen in FIG. 3, the edge guide 60 is thus caused to be located beneath the paper path.

What has been described therefore is an improved friction feed tractor for use with a printer also having a pin feed tractor. When the pin feed tractor is used, the friction feed tractors can be simply placed in their storage positions and need not be disassembled.

What we claim as new and desire to secure by Letters Patent of the United States is:

1. A friction feed tractor for moving paper along predetermined paper path and comprising:
   - a frame,
   - a rotatable drive roller carried by said frame,
   - a pressure roller mechanism rotatably carried by said frame and including a rotatable pressure roller and a rotatable carrier for said pressure roller,
   - said drive roller, said pressure roller and said carrier being rotatable about respecting different but parallel axes,
   - said pressure roller mechanism having a use position disposed on one side of the paper path to engage paper therein and a storage position disposed on the opposite side and out of the paper path,
   - a paper edge guide rotatably carried by said frame for guiding paper toward said drive roller, said paper edge guide having use and storage positions respectively also respectively disposed in and out of said paper path,
   - means for rotatably moving said carrier to move said pressure roller toward said drive roller when in said use position and for also rotatably moving said carrier to move said pressure roller into the storage position, and cam means affixed to said paper edge guide and automatically responsive to said last named movement of the carrier to its storage position for also simultaneously moving said paper edge guide into its storage position.

2. The arrangement of claim 1 wherein said means for rotatably moving said carrier includes means for moving said pressure roller mechanism by only a first predetermined increment so that said pressure roller is spaced from said drive roller without moving said paper edge guide into the storage position.

3. The friction feed tractor of claim 2, wherein said means for moving said pressure roller by only a first predetermined increment includes a finger grip plate having a camming surface and a shoulder, said camming surface normally being in contact with said frame, said camming surface being movable along said frame to place said shoulder in contact with said frame and thereby place the pressure roller away from said drive roller.

4. The friction feed tractor of claim 3, wherein said finger grip plate is rotatable.

5. The friction feed tractor of claim 1 wherein said pressure roller carrier mechanism includes:

a platelike arm rotatably mounted adjacent one end thereof to said frame, said pressure roller being rotatably mounted adjacent the other end of said arm, and means for slightly moving said pressure roller including a finger grip plate rotatably mounted about the same axis of rotation as said pressure roller, said finger grip plate having a camming surface and a shoulder, said camming surface being normally in contact with said frame, said camming surface being movable along said frame to place said shoulder in contact with said pressure roller and thereby place the pressure roller slightly away from said drive roller.

6. The friction feed apparatus of claim 5, further comprising:

means for biasing said pressure roller mechanism into the use position and holding said pressure roller against said drive roller, said finger grip plate including a portion accessible either to manually pull said pressure roller mechanism against the force of said biasing means to the storage position, or to manually rotate said finger grip plate to move said camming surface along said frame to place said pressure roller slightly away from said drive roller.

7. The friction feed tractor of claim 6, wherein said platelike arm at said other end thereof carries a tab, said means for slightly moving further including a shoulder on said finger grip plate arranged to engage said tab when said finger grip plate is being rotated and thereby move said pressure roller slightly away from said drive roller.

8. A friction feed tractor for moving paper along a predetermined paper path and comprising:

a frame, a drive roller carried by said frame, a pressure roller mechanism carried by said frame and including a pressure roller and a carrier for said pressure roller rotatably mounted to said frame, said pressure roller mechanism having roller use and roller storgae positions respectively in and out of the paper path, means biasing said pressure roller mechanism into the roller use position and biasing said pressure roller towards said drive roller, means for moving said pressure roller mechanism against the force of said biasing means into the roller storage position, a paper edge guide movably mounted with respect to said frame and having guide use and guide storage positions also respectively in and out of the paper path, said paper edge guide being engageable by said pressure roller mechanism in response to movement of said pressure roller to said roller storage position to automatically also move said paper edge guide from its guide use to its guide storage position.

9. The friction feed tractor of claim 8, wherein:

said frame has a recess formed therein to receive said pressure roller in the roller storage position, and said paper edge guide has a camming surface transversely aligned with said recess so as to be engaged by said pressure roller mechanism as it is moved to the roller storage position thereby moving said paper edge guide to its guide storage position.

10. The friction feed tractor of claim 8, wherein:

said paper edge guide includes a camming surface engageable by said pressure roller mechanism as it is being moved to the roller storage position to thereby also move said paper edge guide to the guide storage position, said means for biasing and said pressure roller mechanism being arranged in an over-center construction having first and second stable conditions respectively corresponding to the roller use and roller storage positions, said pressure roller in the first stable condition being held against said driver roller, said pressure roller in the second stable condition being pulled against said frame to move said paper edge guide to the guide storage position.

11. The friction feed tractor of claim 8, wherein:

said pressure roller mechanism includes a platelike arm rotatably mounted adjacent one end thereof to said frame, said pressure roller being rotatably mounted adjacent the other end of said arm, and said paper edge guide being rotatably mounted about the same axis of rotation as said platelike arm and being rotatable between said guide use and guide storage positions.

12. The friction feed tractor of claim 8, and further comprising second biasing means biasing said paper edge guide into the guide use position.

13. The friction feed tractor of claim 12, wherein:

said first-mentioned biasing means includes a first spring connected to said pressure roller means and to said frame at a predetermined point thereon, and said second biasing means includes a second spring connected to said paper edge guide and to same frame at said predetermined point thereon.

14. In combination, alternatively usable pin feed and friction feed tractors for moving paper along a predetermined paper path and comprising:

a frame, a drive roller carried by said frame, a pressure roller mechanism carried by said frame and including a pressure roller and a carrier for said pressure roller, said pressure roller mechanism having use and storage positions respectively in and out of the paper path, a paper edge guide for guiding paper toward said drive roller, said paper edge guide having use and storage positions respectively, means for moving said pressure roller towards said drive roller, means for moving said pressure roller mechanism from its use to its storage position, means automatically responsive to said last named movement of the pressure roller mechanism to its storage position for also simultaneously moving said paper edge guide from its use to its storage position, and a pin feed tractor movable into operative position when said edge guide and pressure roller are in their storage positions whereat they operate as paper supports for pin feed tractor operation.

* * * * *